US005888349A

United States Patent [19]

Lau et al.

[11] Patent Number: 5,888,349

[45] Date of Patent: Mar. 30, 1999

[54] METHOD FOR STABILIZING A MOVING LOW-STRENGTH SHEET

[75] Inventors: Jark C. Lau, Roswell, Ga.; Philip Sim Lin, Oshkosh, Wis.

[73] Assignee: Kimberly-Clark Worldwide, Inc., Neenah, Wis.

[21] Appl. No.: 40,598

[22] Filed: Mar. 18, 1998

Related U.S. Application Data

[62] Division of Ser. No. 655,332, May 24, 1996, Pat. No. 5,759,352.

[51] Int. Cl.[6] ..... B65H 20/14

[52] U.S. Cl. ..... 162/199; 226/7; 162/202; 162/198; 242/615.11

[58] Field of Search ..... 162/198, 199, 162/263, 272, 281, 283, 202, 197; 226/7, 97; 34/114, 117, 118, 119, 120, 122; 244/123; 242/615, 615.11, 152, 147 A

[56] References Cited

U.S. PATENT DOCUMENTS

| | | | |
|---|---|---|---|
| 3,358,315 | 12/1967 | Bennett | 15/306 |
| 3,910,531 | 10/1975 | Leomand | 244/119 |
| 4,019,953 | 4/1977 | Nystrom | 162/272 |
| 4,179,330 | 12/1979 | Page | 162/113 |
| 4,186,860 | 2/1980 | Reba | 226/91 |
| 4,321,107 | 3/1982 | Page | 162/198 |
| 4,414,061 | 11/1983 | Trufitt et al. | 162/295 |
| 4,893,741 | 1/1990 | Heinzmann | 226/196 |
| 4,906,333 | 3/1990 | Myren | 162/111 |
| 4,987,630 | 1/1991 | Allen et al. | 15/1.51 |
| 5,007,986 | 4/1991 | Gustavsson et al. | 162/281 |
| 5,011,574 | 4/1991 | Gustavsson et al. | 162/281 |
| 5,022,166 | 6/1991 | Nguyen et al. | 34/120 |
| 5,163,369 | 11/1992 | Hawitt | 101/423 |
| 5,181,678 | 1/1993 | Widnall et al. | 244/219 |
| 5,252,381 | 10/1993 | Adler | 428/156 |
| 5,379,526 | 1/1995 | Haverinen | 34/114 |
| 5,438,765 | 8/1995 | Tyrmi et al. | 34/456 |
| 5,509,215 | 4/1996 | Koiranen et al. | 34/117 |

*Primary Examiner*—Stanley S. Silverman
*Assistant Examiner*—Josey A. Fortuna
*Attorney, Agent, or Firm*—William E. Maycock

[57] ABSTRACT

A method of stabilizing a low strength sheet which involves passing the sheet under an apparatus having a width and a top surface and moving in a first direction at a rate sufficient to entrain air. The apparatus includes an airfoil adapted to extend along the top surface of the sheet. The airfoil, in turn, includes:

a bottom surface adapted to extend along a portion of the top surface of the sheet;

a first surface extending a first distance from the bottom surface at a first juncture;

a second surface extending a second distance from the bottom surface at a second juncture; and a top surface extending from the first surface at a third juncture to the second surface at a fourth juncture. The first distance in general is less than the second distance. In addition, the apparatus is oriented in a manner such that the portion of the apparatus which first encounters the entrained air is the first surface of the airfoil, and the first and bottom surfaces of the airfoil form an acute angle such that the first surface directs a substantial portion of the entrained air away from the sheet. The apparatus may include a forebody, a passageway, and/or a deflector.

12 Claims, 2 Drawing Sheets

METHOD FOR STABILIZING A MOVING LOW-STRENGTH SHEET

This is a divisional application of 08/655,332 filed on May 24, 1996 now U.S. Pat. No. 5,759,352.

BACKGROUND OF THE INVENTION

The present invention relates to a moving low-strength sheet.

A wide variety of sheets are prepared continuously on a commercial scale, often at line speeds of the order of 5,000 feet per minute or ft/min (about 1,500 meters per minute or m/min). When the continuously moving sheet has a very low basis weight or has a loose structure, sheet movement can create a variety of problems associated with the low strength of the sheet.

By way of illustration only, tissue machines support a wet sheet throughout the forming, pressing, and drying processes. Tension is not applied to the sheet until it has been dried. The most common design involves a forming section and a Yankee dryer. The Yankee dryer cylinder is a large diameter, steam-heated cylinder which serves as the major drying unit. The wet sheet is pressed tightly against the highly polished surface of the cylinder and is transferred to it. The Yankee dryer is enclosed by an air hood and may utilize high-velocity air impingement to increase the drying capacity.

If desired, the sheet may be creped as it leaves the Yankee dryer cylinder to enhance bulk and stretch properties. Creping occurs because of the adherence of the sheet to the dryer cylinder as it comes up against the square edge of a creping doctor.

The creped sheet is very fragile and is subject to a variety of instability and other problems as it travels from the doctor over open spans to and between subsequent rolls and supports, as well as ancillary equipment, before being taken up on a reel drum. The moving sheet imparts momentum to a layer of air adjacent to a sheet surface, giving rise to an entrained boundary layer of air. As the entrained air encounters rolls, supports, and other equipment, turbulent air patterns are established which cause, among other problems, fluttering, which results in tearing of the sheet, and dust generation. These problems, of course, are not limited to creped sheets. They often are associated with any moving low-strength or low basis weight and fragile sheet.

SUMMARY OF THE INVENTION

The present invention addresses some of the difficulties and problems discussed above by providing an apparatus for stabilizing a low-strength sheet having a width and a top surface and moving in a first direction at a rate sufficient to entrain air. The apparatus includes an airfoil adapted to extend along the top surface of the sheet. The airfoil, in turn, includes:

- a bottom surface adapted to extend along a portion of the top surface of the sheet;
- a first surface extending a first distance from the bottom surface at a first juncture;
- a second surface extending a second distance from the bottom surface at a second juncture; and
- a top surface extending from the first surface at a third juncture to the second surface at a fourth juncture.

The first distance in general is less than the second distance. For example, the first distance may be less than about 25 percent of the second distance.

The apparatus is oriented in a manner such that the portion of the apparatus which first encounters the entrained air is the first surface of the airfoil, and the first and bottom surfaces of the airfoil form an acute angle such that the first surface directs a substantial portion of the entrained air away from the sheet.

The apparatus may include a passageway having an entrance, a lower surface, an upper surface, and opposing side walls, wherein at least a portion of the lower surface is adjacent to the top surface of the airfoil and the entrance is positioned near the first surface of the airfoil.

Alternatively, the apparatus may include a deflector positioned near the first surface and adapted to direct the substantial portion of entrained air in a desired direction. For example, the deflector may be adapted to direct the substantial portion of entrained air in a direction which is approximately 180° from the first direction, in which case the deflector may be arcuately shaped.

The deflector may include a passageway having an entrance, a lower surface, an upper surface, and opposing side walls, wherein at least a portion of the lower surface is adjacent to the top surface of the airfoil, the entrance is positioned near the first surface of the airfoil, and the upper surface and the deflector meet at a fifth juncture near the first surface of the airfoil.

The apparatus may further include a forebody located adjacent to the first surface of the airfoil. The forebody includes:

- a bottom surface adapted to extend along a portion of the top surface of the sheet;
- a first surface extending a first distance from the bottom surface at a first juncture;
- a second surface extending a second distance from the bottom surface at a second juncture; and
- a top surface extending from the first surface at a third juncture to the second surface at a fourth juncture; in which the apparatus is oriented in a manner such that the portion of the apparatus which first encounters the entrained air is the first surface of the forebody, the first surface of the forebody is adapted to direct a substantial portion of the entrained air away from the sheet, and the second surface and the bottom surface of the forebody form an obtuse angle.

In certain embodiments, the second surface of the forebody and the first surface of the airfoil are substantially planar and parallel. In these or other embodiments, each of the first distance and the second distance of the forebody may be less than the first distance of the airfoil. The apparatus may include a deflector adapted to direct the substantial portion of entrained air in a desired direction. The deflector may be located either near the top surface of the forebody or near the first surface of the airfoil. If desired, the deflector may be adapted to direct the substantial portion of entrained air in a direction which is approximately 180° from the first direction, in which case the deflector may be arcuately shaped.

When the deflector is located near the first surface of the airfoil, it may include a passageway having an entrance, a lower surface, an upper surface, and opposing side walls, wherein at least a portion of the lower surface is adjacent to the top surface of the airfoil, the entrance is positioned near the first surface of the airfoil, and the upper surface and the deflector meet at a fifth juncture near the first surface of the airfoil.

The present invention also provides a method of stabilizing a low-strength sheet having a width and a top surface, which method involves:

transferring the sheet in a first direction over an open draw from a first supported location to a second supported location at a rate sufficient to entrain air; and passing the sheet under the apparatus described hereinbefore, which apparatus is located in the open draw.

The apparatus and method of the present invention effectively stabilize moving low-strength sheets, thereby significantly reducing tearing or rupturing of the sheet. In addition, the method and apparatus of the present invention provide an effective means for dust removal.

DETAILED DESCRIPTION OF THE INVENTION

As used herein, the term "airfoil" is meant to include any body whose shape causes it to receive a useful reaction from an air stream moving relative to it. The term "useful reaction" with respect to the present invention refers to the stabilization of the moving sheet.

The term "entrained air" refers to the layer of air adjacent to a surface of a moving sheet to which momentum is imparted by the moving sheet. Such momentum is in the direction of motion of the sheet and is proportional to the velocity of the sheet.

As used herein, the term "distance" in a phrase such as "a first surface extending a first distance from the bottom surface" means a perpendicular distance and is equivalent to thickness.

The term "acute angle is used herein to mean an angle less than 90°. The term "obtuse angle" is used herein to mean an angle greater than 90°.

For convenience, the present invention will be described in conjunction with a process for manufacturing a creped paper in which a sheet of tissue is creped as it leaves a Yankee dryer cylinder. It is to be understood, however, that the present invention is not to be limited to a creping process and is applicable to any moving low-strength or fragile sheet which passes over an open draw.

Figure 1:
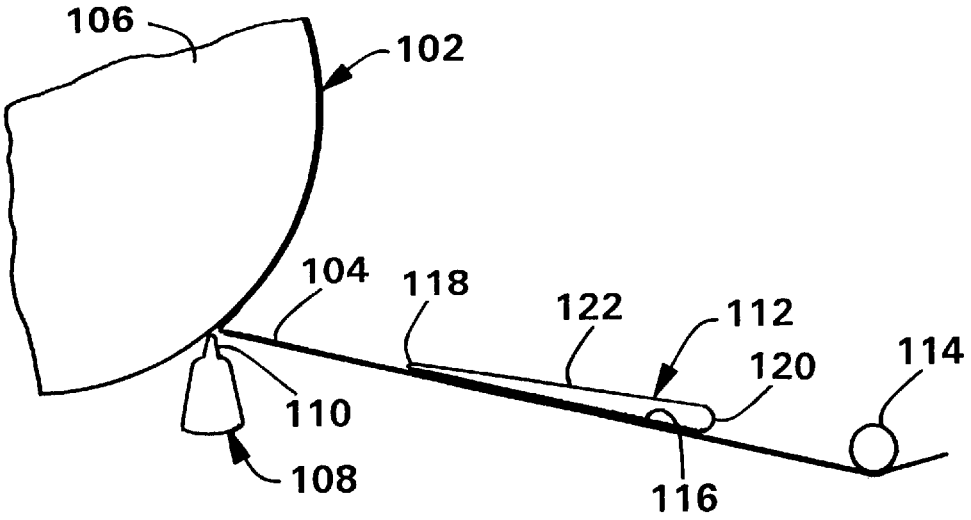
FIG. 1 is a diagrammatic representation of the creping section of a creped tissue manufacturing process in which an apparatus of the present invention, consisting of a first embodiment of an airfoil, is employed.

With reference to FIG. 1, a tissue sheet 102 having a top surface 104 adhering to a clockwise-rotating Yankee dryer cylinder 106 is rotated downwards to a creping doctor 108 where the tissue sheet 102 is creped off of the Yankee dryer cylinder 102 by a doctor blade 110. The creped tissue first passes under an apparatus of the present invention which consists of a first embodiment of an airfoil 112 and then under a guide or support roll 114. The airfoil 112 has bottom surface 116 which extends along a portion of the top surface 104 of the tissue sheet 102. The airfoil also has a first surface 118, a second surface 120, and a top surface 122. In FIG. 1, the Yankee dryer cylinder 106 is a first supported location and the guide or support roll 114 is a second supported location.

Figure 2A:
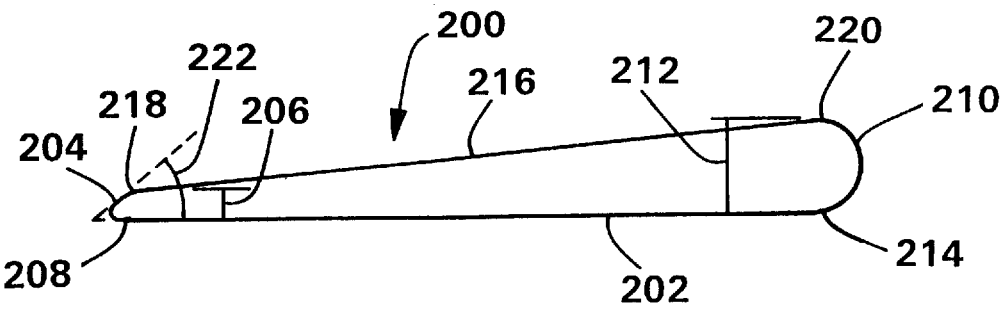
FIG. 2A is a diagrammatic representation of the airfoil depicted in FIG. 1.

The airfoil 112 of FIG. 1 is show diagrammatically in greater detail in FIG. 2A. FIG. 2A shows an airfoil 200 which has a bottom surface 202. A first surface 204 extends a distance 206 from the bottom surface 202 at a first juncture 208. Thus, the distance 206 represents the thickness of the airfoil 200 in the region of the first surface 204. Similarly, a second surface 210 extends a distance 212 from the bottom surface 202 at a second juncture 214. The distance 212 represents the thickness of the airfoil 200 in the region of the second surface 210. A top surface 216 extends from the first surface 204 at a third juncture 218 to the second surface 210 at a fourth juncture 220. Finally, the first surface 204 and the bottom surface 202 form an acute angle 222.

Figure 2B:
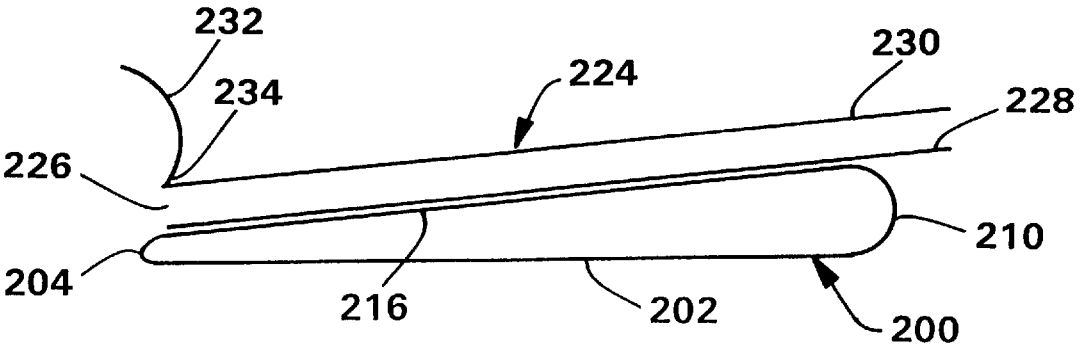
FIG. 2B is a diagrammatic representation of the airfoil depicted in FIG. 2A, in combination with a passageway and a deflector.

The combination of the airfoil 200 of FIG. 2A with a passageway and a deflector is shown diagrammatically in FIG. 2B, in which like numbers have like meanings. In FIG. 2A, an airfoil 200 has a bottom surface 202, a first surface 204, a second surface 210, and a top surface 216 which extends from the first surface 204 to the second surface 210. A passageway 224 is located above the airfoil 200. The passageway 224 has an entrance 226, a lower surface 228, an upper surface 230, and opposing side walls (not shown). The location of the passageway 224 is such that the lower surface 228 of the passageway is adjacent to the top surface 216 of the airfoil 200. If desired, the top surface 216 of the airfoil may be formed by a portion of the lower surface 228 of the passageway. Finally, a deflector 232 is positioned at the entrance 226 of the passageway 224 and meets the upper surface 224 of the passageway 224 at a fifth juncture 234. The deflector 232 is arcuately shaped and adapted to direct the substantial portion of entrained air back towards the Yankee dryer cylinder (not shown), i.e., in a direction which is approximately 180° from the first direction in order to feed the boundary layer where the sheet leaves the first support.

The passageway 224 provides an effective means for the removal of dust which is carried in the entrained air. If desired, suction may be applied to the passageway to assist in such removal.

Figure 3A:
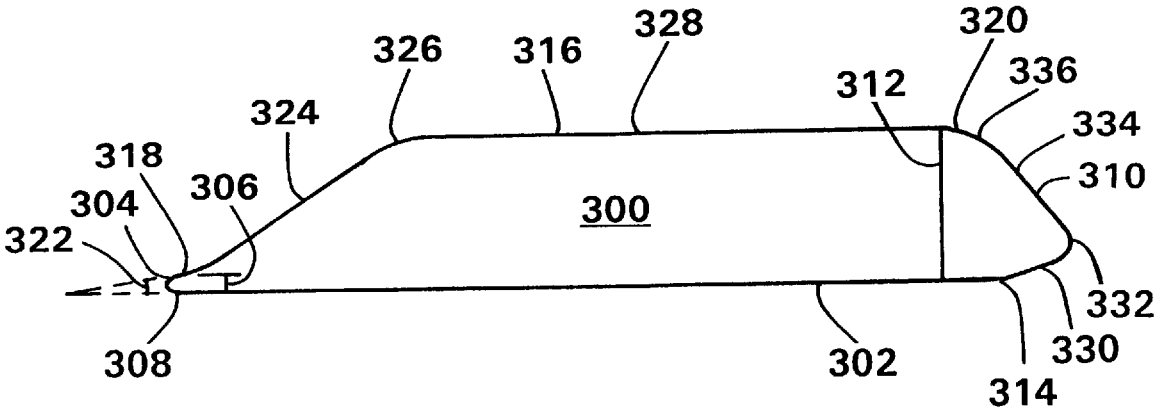
FIG. 3A is a diagrammatic representation of an apparatus of the present invention, consisting of a second embodiment of an airfoil.

Another embodiment of the apparatus of the present invention is shown diagrammatically in FIG. 3A which shows an airfoil 300. The airfoil 300 has a bottom surface 302. A first surface 304 extends a distance 306 from the bottom surface 302 at a first juncture 308. Thus, the distance 306 represents the thickness of the airfoil 300 in the region of the first surface 304. Similarly, a second surface 310 extends a distance 312 from the bottom surface 302 at a second juncture 314. The distance 312 represents the thickness of the airfoil 300 in the region of the second surface 310. A top surface 316 extends from the first surface 304 at a third juncture 318 to the second surface 310 at a fourth juncture 320. The first surface 304 and the bottom surface 302 form an acute angle 322. The top surface 316 consists of an essentially planar first section 324 which slopes upwardly from the first junction 318, away from the first surface 304. The first section 324 of the top surface 316 joins a slightly curved second section 326 which in turn joins an essentially planar third section which meets the second surface 310 at the fourth juncture 320. The third section 328 of the top surface 316 is essentially parallel with the bottom surface 302. The second surface 310 also consists of three section. The first section 330 is essentially planar and extends upwardly at a small angle and away from the first surface. The first section 330 joins a curved second section 332 to which an essentially planar third section 334 is joined, which third section 334 now extends toward the first surface 304. The third section 334 is joined to the third section 328 of the top surface 316 at the fourth juncture 320 by means of a slightly curved fourth section 336.

Figure 3B:
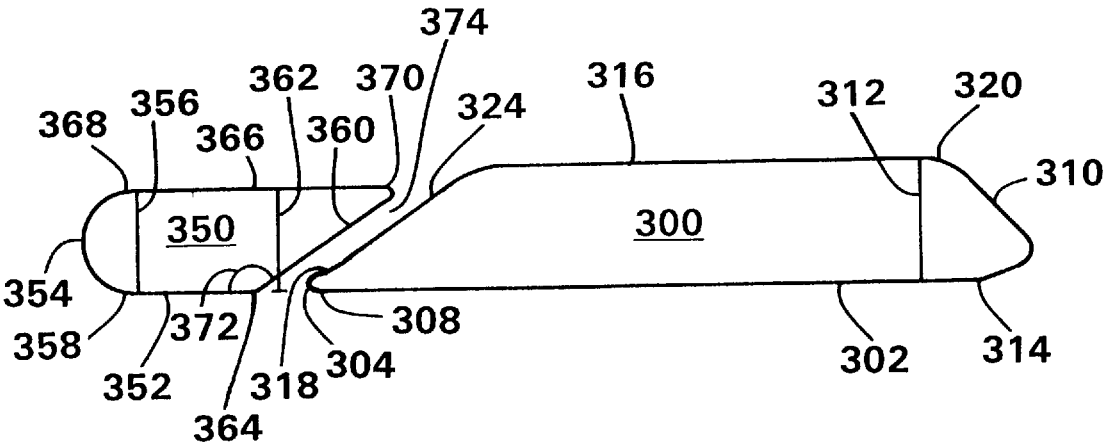
FIG. 3B is a diagrammatic representation of the airfoil depicted in FIG. 3A, in combination with a forebody.

The combination of the airfoil 300 of FIG. 3A with a forebody is shown diagrammatically in FIG. 3B, in which like numbers have like meanings. In FIG. 3B, the airfoil 300 has a bottom surface 302. A first surface 304 extends from the bottom surface 302 at a first juncture 308. A second surface 310 extends a distance 312 from the bottom surface 302 at a second juncture 314. The distance 312 represents the thickness of the airfoil 300 in the region of the second surface 310. A top surface 316 extends from the first surface 304 at a third juncture 318 to the second surface 310 at a fourth juncture 320. The top surface 316 includes an essentially planar first section 324 which slopes upwardly from the first junction 318, away from the first surface 304.

A forebody 350 is located near the airfoil 300. The forebody 350 has a bottom surface 352. A first surface 354 extends a distance 356 from the bottom surface 352 at a first juncture 358. Thus, the distance 356 represents the thickness of the forebody 350 in the region of the first surface 354. A second surface 360 extends a distance 362 from the bottom surface 352 at a second juncture 364. The distance 362 represents the thickness of the forebody 350 in the region of the second surface 360. In the embodiment shown, the first distance 356 and the second distance 362 are equal. A top surface 366 extends from the first surface 354 at a third juncture 368 to the second surface 360 at a fourth juncture 370. The bottom surface 352 and the second surface 360 form an obtuse angle 372.

The forebody 350 is located near the airfoil 300, such that a channel 374 is formed between the second surface 360 of the forebody and the first surface 304 and the first section 324 of the top surface 316 of the airfoil 300. In the embodiment shown, the second surface 360 of the forebody and the first section 324 of the top surface 316 of the airfoil 300 are essentially parallel.

The present invention also provides a method of stabilizing a low-strength sheet having a width and a top surface, which method involves:

transferring the sheet in a first direction over an open draw from a first supported location to a second supported location at a rate sufficient to entrain air; and passing the sheet under the apparatus described hereinbefore, which apparatus is located in the open draw.

The method of the present invention is particularly useful in the manufacture of a creped tissue. The creped tissue may have, by way of example, a basis weight of from about 11 to about 13 grams per square meter (gsm). The method has been used successfully at line speeds up to about 4600 feet per minute (about 1400 meters per minute). However, the method is expected to be useful at even higher line speeds.

Desirably, the apparatus of the present invention is movably mounted above the first surface of the moving sheet and has a width equal to or greater than that of the moving sheet. As the apparatus is gradually lowered toward the top surface of the moving sheet, the sheet eventually is gently brought against the bottom surface of the airfoil by a pressure differential which results from the rapid movement of entrained air separated over the top of the airfoil, creating low pressure in the vicinity of the second surface of the airfoil. In addition, the entrained air below the sheet contributes to the pressure differential.

When a forebody of the type shown in FIG. 3B is present, a portion of the entrained air is directed first over the top surface of the forebody and then over the top surface of the airfoil. However, a portion of the entrained air flows under the forebody between the bottom surface of the forebody and the top surface of the moving sheet. The air flowing under the forebody then moves upwardly through the channel formed by the second surface of the forebody and the first surface of the airfoil and/or a portion of the top surface of the airfoil. The moving sheet then is gently pressed against the bottom surface of the airfoil.

The use of a forebody as just described is advantageous when dust removal is desired. Except for extremely fine dust particles, most of the dust moves with the entrained air which is relatively close to the moving sheet. The apparatus may include a passageway adjacent to a portion of the top surface of the airfoil, the entrance to which is near the channel formed between the forebody and the airfoil as already described. Because dust-laden entrained air tends to flow under the forebody into the channel, it may be removed from the environment of the sheet-forming apparatus. Of course, a passageway may be used for a similar purpose in the absence of a forebody.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto. For example, more than one apparatus of the present invention may be used, if desired. In addition, the apparatus of the present invention may be placed anywhere it is either convenient or necessary. That is, the apparatus need not be placed in the open draw immediately following creping. A passageway, with or without a deflector, may be employed with the apparatus. More than one passageway and/or more than one deflector also may be employed in combination with an airfoil or with the combination of an airfoil and a forebody.

In addition, it should be understood that the apparatus of the present invention may be placed underneath a moving sheet, rather than above the sheet as depicted in FIG. 1. In this case, the terms "top" and "bottom" become reversed from the perspective of a machine operator, but the relative orientation of the sheet to the apparatus remains unchanged. Moreover, the forebody first and second distances need not be equal, as shown in FIG. 3B. The configurations of the first and second surfaces of the forebody and the airfoil may be other than as depicted in the drawings. For example, the second surface of the airfoil may be arcuate, or cylindrical, in shape. Finally, surfaces shown as being parallel in the drawings may be nonparallel. Still other variations will be apparent to those having ordinary skill in the art.

What is claimed is:

1. A method of stabilizing a moving low-strength sheet having a width and a top surface, which moving sheet is moving a first direction at a rate sufficient to impart a layer of air adjacent to a surface of the sheet a momentum which is in the direction of motion thereof, giving rise to an entrained boundary layer of air, which method comprises:

transferring the sheet in a first direction over an open draw from a first supported location to a second supported location at a rate sufficient to entrain air; and passing the sheet under an apparatus located in the open draw, the apparatus comprising an airfoil extending along the top surface of the sheet, which airfoil comprises:

a bottom surface extending; along a portion of the top surface of the sheet;

a first surface extending a first distance from the bottom surface at a first juncture;

a second surface extending a second distance from the bottom surface at a second juncture; and a top surface extending from the first surface at a third juncture to the second surface at a fourth juncture; and a deflector positioned near the first surface of the airfoil, which deflector directs the substantial portion of entrained boundary layer of air in a desired direction, in which:

the first distance is less than the second distance;

the apparatus is oriented in a manner such that the portion of the apparatus which first encounters the entrained boundary layer of air is the first surface of the airfoil; and the first surface is directing a substantial portion of the entrained boundary layer of air away from the sheet.

2. The method of claim 1, in which the deflector includes a passageway having an entrance, a lower surface, an upper surface, and opposing side walls, wherein at least a portion of the lower surface is adjacent to the top surface of the airfoil and the entrance is positioned near the first surface of the airfoil, and the upper surface and the deflector meet at a fifth juncture near the first surface of the airfoil.

3. The method of claim 1, in which the deflector is directs the substantial portion of entrained boundary layer of air in a direction which is approximately 180° form the first direction.

4. The method of claim 3, in which the deflector is arcuately shaped.

5. The method of claim 1, in which the deflector includes a passageway having an entrance, a lower surface, an upper surface, and opposing side walls, wherein at least a portion of the lower surface is adjacent to the top surface of the airfoil, the entrance is positioned near the first surface of the airfoil, and the upper surface and the deflector meet at a fifth juncture near the first surface of the airfoil.

6. The method of claim 1, in which the apparatus further comprises a forebody located adjacent to the first surface of the airfoil, the forebody comprising:

a bottom surface extending along a portion of the top surface of the sheet;

a first surface extending a first distance from the bottom surface at a first juncture;

a second surface extending a second distance from the bottom surface at a second juncture; and a top surface extending from the first surface at a third juncture to the second surface at a fourth juncture; in which:

the second surface of the forebody and the bottom surface of the forebody form an obtuse angle;

the forebody is oriented in a manner such that the second surface of the forebody is near the first surface of the airfoil, forming a channel therebetween;

the apparatus is oriented in a manner such that the portion of the apparatus which first encounters the entrained boundary layer of air is the first surface of the forebody; and the first surface of the forebody directs a substantial portion of the entrained boundary layer of air away from the sheet.

7. The method of claim 6, in which the second surface of the forebody and the first surface of the airfoil and/or a portion of the top surface of the airfoil are substantially planar and parallel.

8. The method of claim 7, in which each of the first distance and the second distance of the forebody is less than the second distance of the airfoil.

9. The method of claim 8, which the deflector includes a passageway having an entrance, a lower surface, an upper surface, and opposing side walls, wherein at least a portion of the lower surface is adjacent to the top surface of the airfoil, the entrance is positioned near the first surface of the airfoil, and the upper surface and the deflector meet at a third juncture near the first surface of the airfoil.

10. The method of, claim 7, in which the deflector is positioned near the first surface of the forebody and directing the substantial portion of entrained boundary layer of air in a desired direction.

11. The method of claim 10, in which the defector directs the substantial portion of entrained boundary layer of air in a direction which is approximately 180° from the first direction.

12. The method of claim 11, in which the deflector is acurately shaped.

* * * * *